US005480311A

United States Patent [19]

Luu

[11] Patent Number: 5,480,311

[45] Date of Patent: Jan. 2, 1996

[54] ELECTRICAL PIPE FITTING WITH INTEGRAL GROUNDING FIXTURE

[75] Inventor: Lu V. Luu, Kowloon, Hong Kong

[73] Assignee: Pacomex Co. Ltd., Hong Kong

[21] Appl. No.: 270,211

[22] Filed: Jul. 11, 1994

[51] Int. Cl.[6] ..... H01R 13/648

[52] U.S. Cl. ..... 439/100; 439/208; 285/127

[58] Field of Search ..... 439/100, 208; 174/78; 285/128, 175, 127

[56] References Cited

U.S. PATENT DOCUMENTS

| | | | |
|---|---|---|---|
| 1,660,498 | 2/1928 | Vibber | 439/208 |
| 2,955,851 | 10/1960 | Scott | 285/127 |
| 3,168,104 | 2/1965 | Mathis | 285/127 |
| 3,424,853 | 1/1969 | Johnson, III | 174/78 |
| 3,832,672 | 8/1974 | Loos | 439/208 |
| 4,090,029 | 5/1978 | Lundeberg | 174/51 |
| 4,106,832 | 8/1978 | Burns | 439/100 |
| 4,312,551 | 1/1982 | Mascolo et al. | 439/100 |
| 4,508,371 | 4/1985 | Maier | 285/127 |
| 5,306,170 | 4/1994 | Luu | 439/100 |
| 5,364,281 | 11/1994 | Leto | 439/100 |

FOREIGN PATENT DOCUMENTS

| | | | |
|---|---|---|---|
| 2139724 | 11/1984 | United Kingdom | 439/100 |

*Primary Examiner*—Gary F. Paumen
*Attorney, Agent, or Firm*—Ostrolenk, Faber, Gerb & Soffen

[57] ABSTRACT

An electrical pipe fitting with integral grounding fixture for securing a grounding wire. The pipe fitting is adapted to be removably secured to an electrical receptacle box. Each electrical pipe fitting includes a hollow metal tubular member for receiving electrical wire. The tubular member is adapted to be coupled as an intermediate section of a grounded electrical pipe. The tubular member has a first end and a second end. The first end is adapted to be coupled to a section of the electrical pipe. The second end includes threads which mate with threads on a collar to secure the fitting to the receptacle box. A raised portion extends from the tubular member and includes an aperture for receiving and securing a grounding wire, whereby a ground path is established between the grounding wire and the electrical pipe. The raised portion can be formed integrally with the tubular member or provided on a separate sleeve which extends over the tubular member. The electrical pipe fitting can be either a straight section, or alternatively, can include an angled corner. A removable cover is provided to cover the opening formed by the angled corner to allow access to the electrical wire. A frictional lock is provided to prevent unintentional dislodging of the cover.

10 Claims, 8 Drawing Sheets

ELECTRICAL PIPE FITTING WITH INTEGRAL GROUNDING FIXTURE

RELATED APPLICATIONS

This is related to application Ser. No. 08/094,213, filed Jul. 21, 1993, now U.S. Pat. No. 5,306,170.

BACKGROUND OF THE INVENTION

1. Field of the Invention

The present invention relates to an electrical pipe fitting having an integral grounding fixture for securing a ground wire (a bonding jumper).

2. Description of the Related Art

Electrical pipe is often used for routing electrical wires in commercial and residential installations. In order to meet present day municipal code requirements, the electrical pipe must be grounded, and fixtures must be provided to electrically connect grounding wires to the grounded electrical pipe.

As shown in FIG. 1, the typical solution is to provide a clamp-on fixture consisting of a base 2 and a U-shaped pipe clamp bracket 4 which are secured around a pipe using screws 6 and 8. A portion 10 of the base 2 receives a grounding wire 11 which is held in grounded connection with the base by screw 12. A section 14 of the base may be used to secure a wire clamping bracket 16 over the grounding wire 11 using screws 18 and 20.

The clamp-on figure illustrated in FIG. 1 suffers from several setbacks, including: (1) the ground connection is subject to failure, for example, if the clamp-on fixture should become loose; (2) the fixture adds expense and physical bulk to any given installation, requiring separate pieces of hardware which must be purchased, kept in stock and secured around the pipe or connector; (3) the clamp-on fixture adds to the time involved and increases the chance of error during the installation, involving several steps in order to secure and apply the grounding connection; and (4) the clamp may cause the electrical pipe, or conduit, to crimp.

Although U.S. Pat. No. 4,106,832 to Burns discloses an electrical ground fixture including a pipe section with an integral clamp, it is designed to electrically couple a grounding wire to a grounded water pipe system of a building. Significantly, the fixture of the Burns patent is not designed to provide a grounding connection for an electrical pipe system to meet today's building and electrical codes.

SUMMARY OF THE INVENTION

It is an object of the present invention to provide an electrical pipe fitting having an integral ground fixture which is specifically designed to be used in an electrical conduit system to bring such a system into compliance with municipal code requirements.

The electrical pipe fitting of the present invention includes a hollow metal tubular member for receiving electrical wire. The tubular member has a first end and a second end. The tubular member is adapted to be coupled as an intermediate section of a grounded electrical pipe at the first end and is also adapted to be removably connected to an electrical receptacle box at the second end. A raised portion extending from the tubular member has an aperture for receiving and securing a grounding wire, whereby a ground path is established between the grounding wire and the electrical pipe. The fitting includes means for securing the grounding wire within the aperture of the raised portion.

Preferably, the means for securing the grounding wire includes a screw which extends into the aperture of the raised portion and presses an uninsulated portion of the grounding wire against the tubular member, and a clamp for securing the uninsulated portion of the grounding wire.

The raised portion can be formed integral with the tubular member or integral with a sleeve which extends over the tubular member.

The electrical pipe fitting can be either a straight section, or alternatively, can include an angled corner. A removable cover is provided to cover the opening formed by the angled corner to allow access to the electrical wire. A frictional lock prevents unintentional dislodging of the cover.

A section of the electrical pipe can be received within the first end of the fitting, and secured therein with a screw which extends through an aperture in the first end of the tubular member. In an alternative embodiment, the section of electrical pipe is received over the first end and secured by a plurality of ridges located on the first end of the tubular member.

The electrical fitting can be removably secured within an electrical receptacle box by a collar having threads which mate with threads located on the second end of the fitting.

Other features and advantages of the present invention will become apparent from the following description of the invention which refers to the accompanying drawings.

DETAILED DESCRIPTION OF THE DRAWINGS

Figure 1:
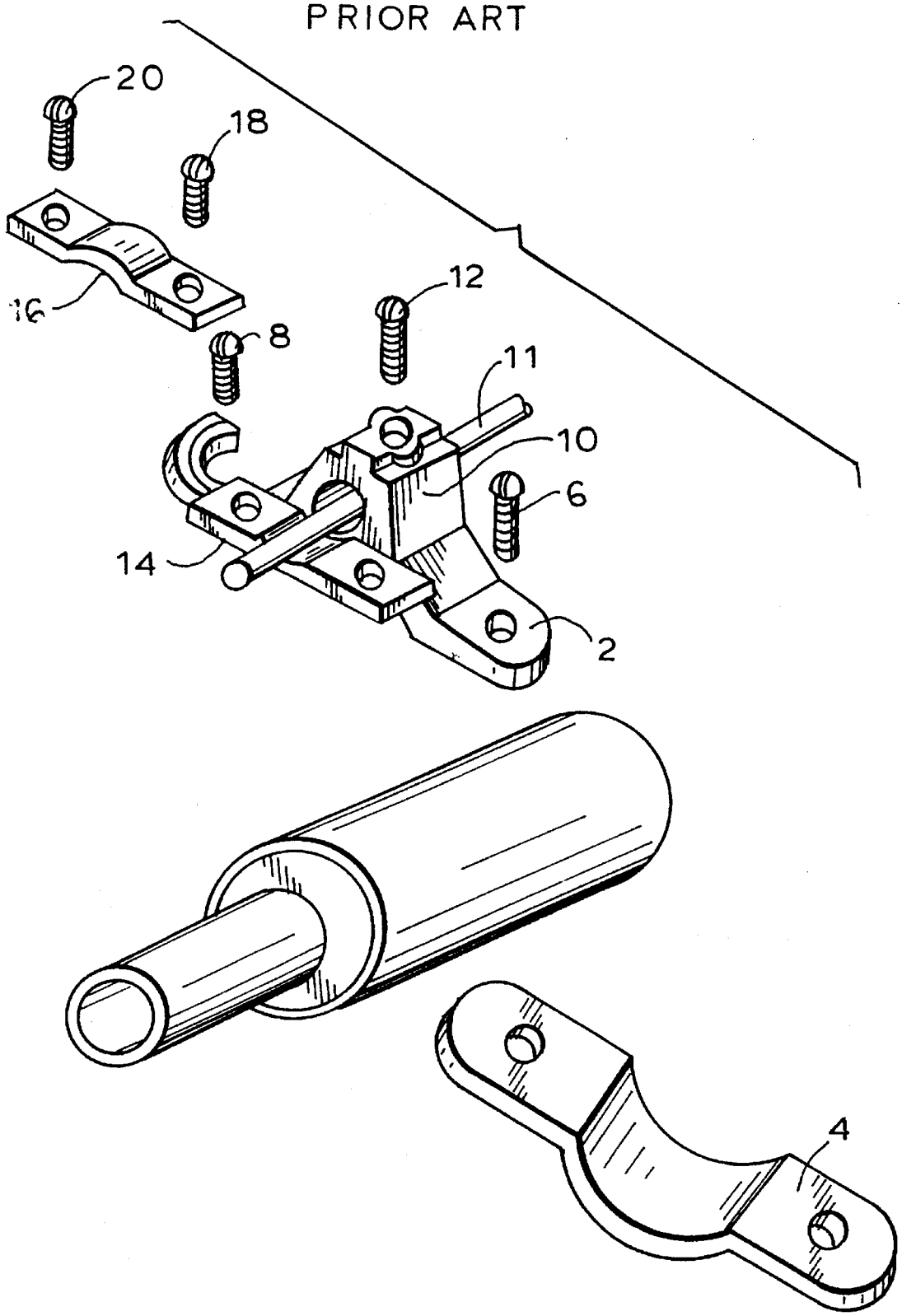
FIG. 1 PRIOR ART
FIG. 1 illustrates a known clamp-on type grounding fixture.
Figure 2:
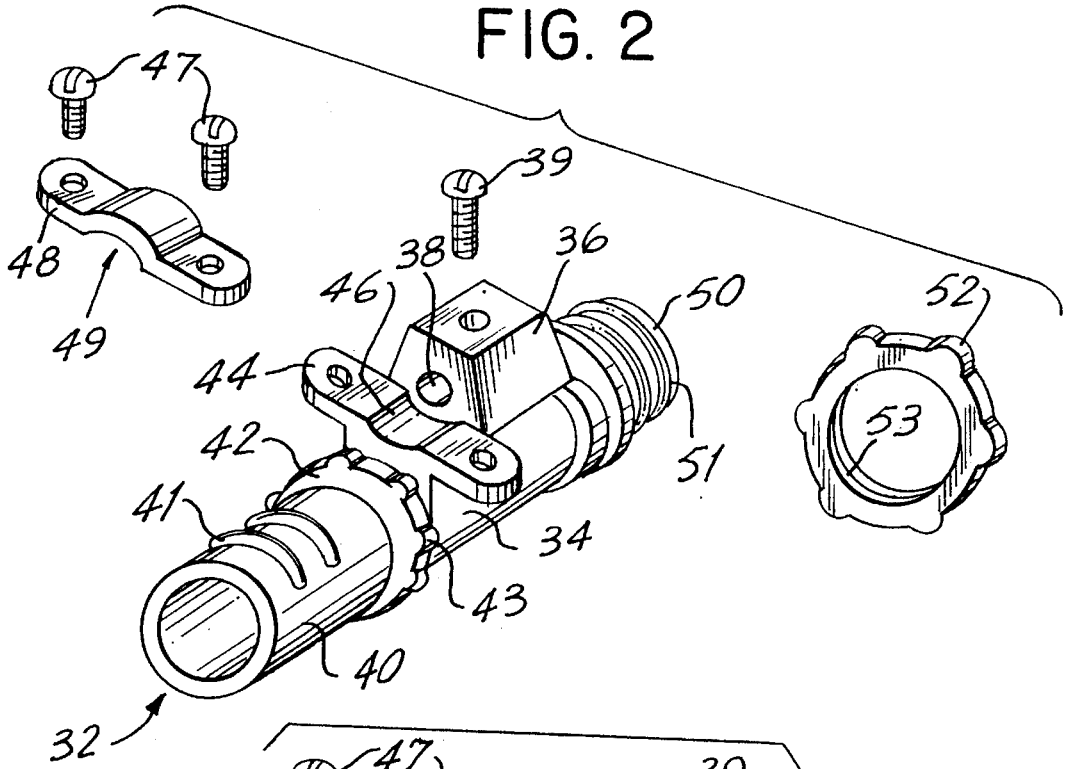
FIG. 2 is a first embodiment of the electrical pipe fitting of the present invention having an integral grounding fixture.

Referring to FIG. 2, the present invention relates to an electrical pipe fitting in the form of a hollow tubular member 34 for receiving electrical wire.

A raised portion 36 extending from tubular member 34 has an aperture 38 for receiving a grounding wire. A screw 39 extends into the aperture and presses an uninsulated portion of a grounding wire against a wall of aperture 38.

The hollow tubular member 34 is adapted to be coupled as an intermediate section of a grounded electrical pipe. Tubular member 34 has a first end 40 which fits snugly inside the end of a piece of electrical pipe or conduit. A number of small ridges 41 extend at least partially circumferentially around the end 40 to assist in securing the end inside the conduit. When the end 40 is inserted fully, the conduit end comes to rest against a collar 42 on the tubular member 34. The collar 42 has raised bumps 43 which afford a better grip on tubular member 34.

A platform 44 disposed adjacent raised portion 36 extends laterally with respect to the tubular member and includes a U-shaped recess 46 for receiving the grounding wire. A wire clamp bracket 48 with an opposing U-shaped recess 44 is secured onto platform 44 with screws 47, the wire being held in place between recesses 46 and 49.

Figure 8:
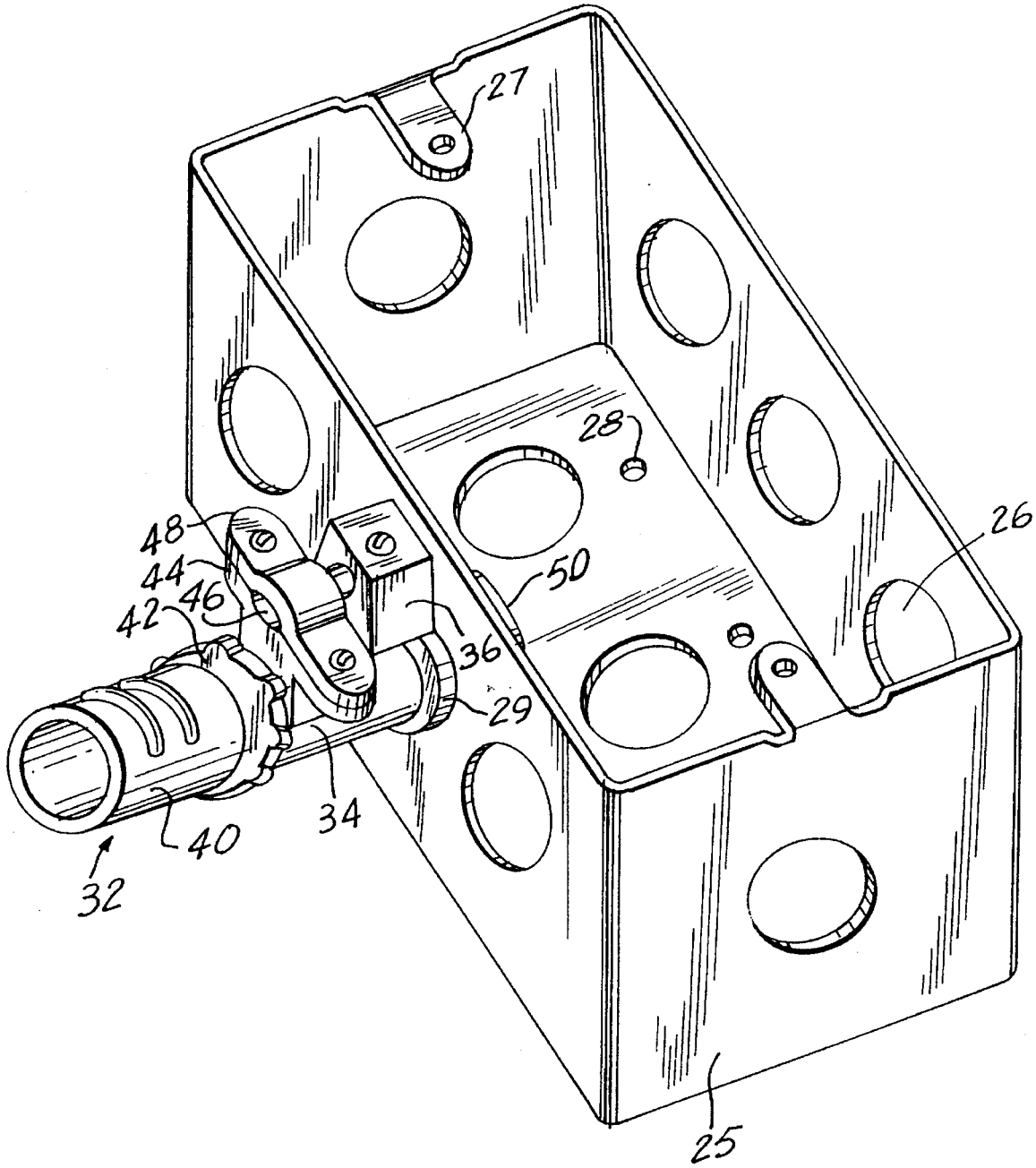
FIG. 8 is a perspective view of an electrical receptacle box with the removable electrical pipe fitting of FIG. 2.

The tubular member 34 is also adapted to be removably connected to an electrical receptacle box. As shown in FIG. 8, a second end 50 of tubular member 34 can be inserted through an opening 29 in the receptacle box 25. The receptacle box 25 has a plurality of removable disc-shaped covers 26, each of which can be easily punched out to provide an aperture for receiving the second end 50 of tubular member 34. The second end 50 of tubular member 34 includes threads 51 which mate with threads 53 of a collar 52 to secure the fitting within the receptacle box. The electrical receptacle box also includes threaded tabs 27 for securing a faceplate, and apertures 28 for receiving screws to secure the receptacle box within a wall or other desired structure.

Figure 3:
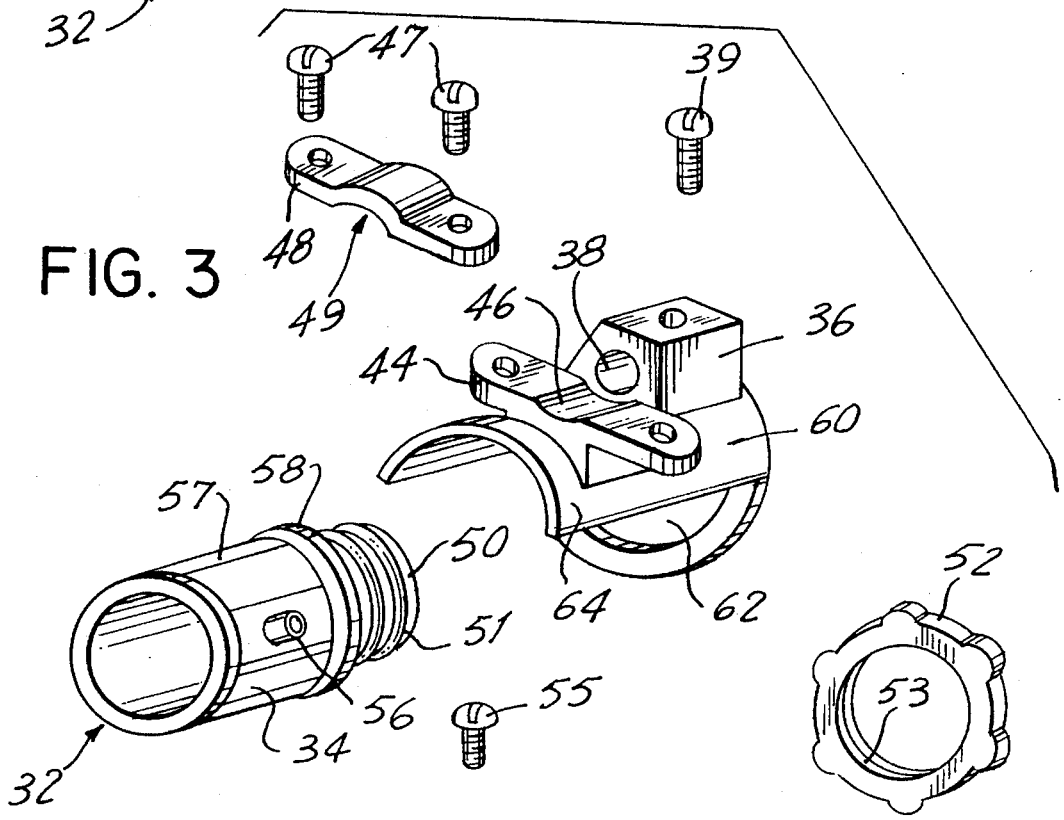
FIG. 3 is a second embodiment of the electrical pipe fitting having a sleeve with an integral grounding fixture.
Figure 9:
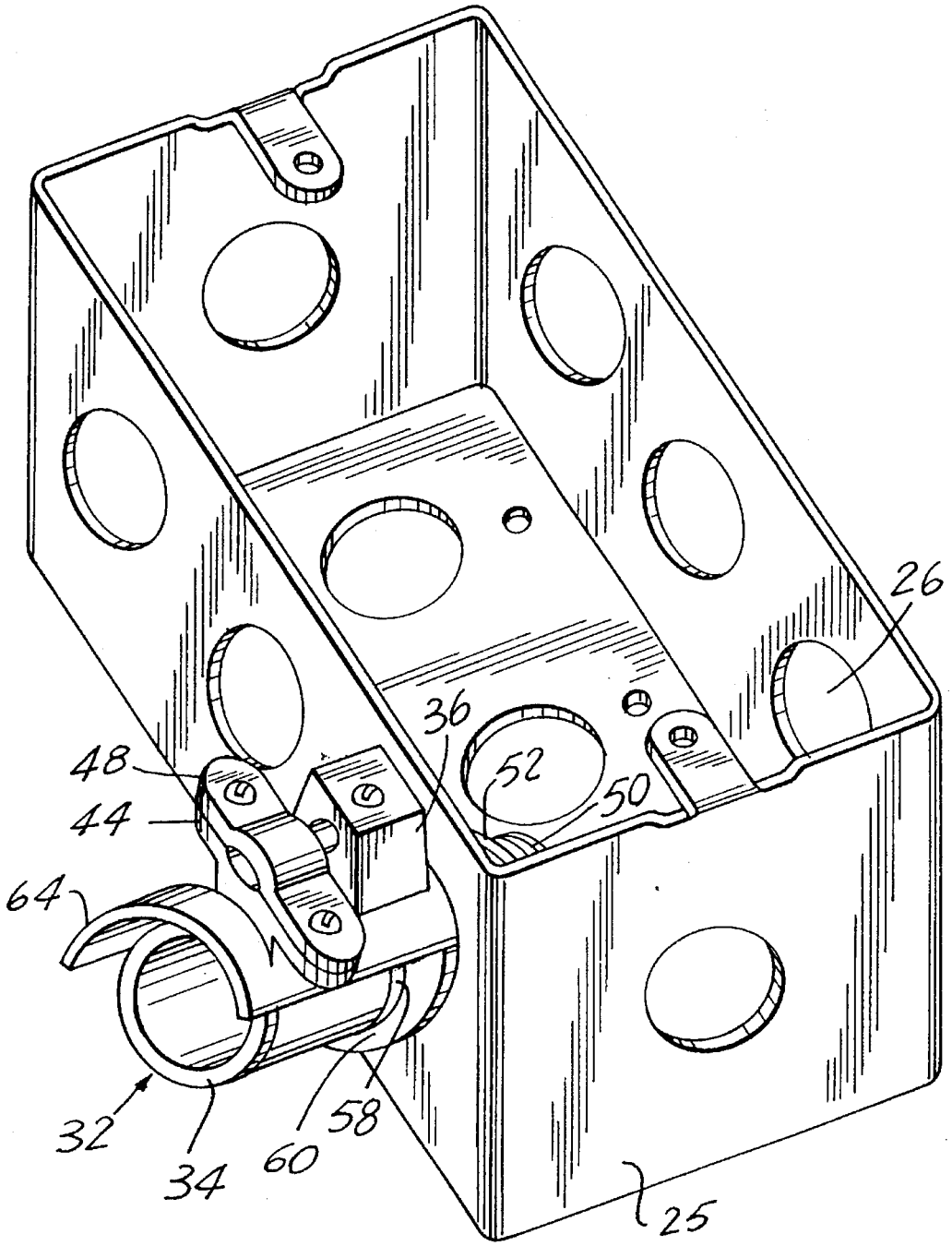
FIG. 9 illustrates a receptacle box with the electrical pipe fitting of FIG. 3.

A second embodiment of the invention is shown in FIGS. 3 and 9, wherein like reference numerals are used to designate like elements in FIGS. 2 and 8. In the second embodiment, the raised portion 36 and platform 44 are disposed on a separate metal sleeve 60, a portion of which, identified by reference number 64, extends over tubular member 34. Sleeve 60 has a hollow collar portion, perpendicular to portion 64, through which the second end 50 of tubular member 34 is inserted, prior to being inserted within the receptacle box. Thus, when tubular member 34 is secured to the receptacle box by tightening threaded collar 53 onto the threads 51 of the second end 50 of tubular member 34, sleeve 60 is secured against the receptacle box by a raised circumferential ridge 58 on tubular member 34.

The second embodiment of the invention shown in FIGS. 3 and 9 also differs from the first embodiment in that electrical pipe fitting 32 comprises a straight tubular member 34 for accommodating electrical wire, but does not include a male end 40 extending therefrom which fits into another section of electrical pipe. Rather, tubular member 34 is a female piece and receives a section of electrical pipe. A screw 55 extends through an aperture 56 in tubular member 34 for securing the fitting to the section of electrical pipe inserted therein. Tubular member 34 includes ridges 57 spaced axially around its periphery to facilitate gripping of the fixture.

Figure 4:
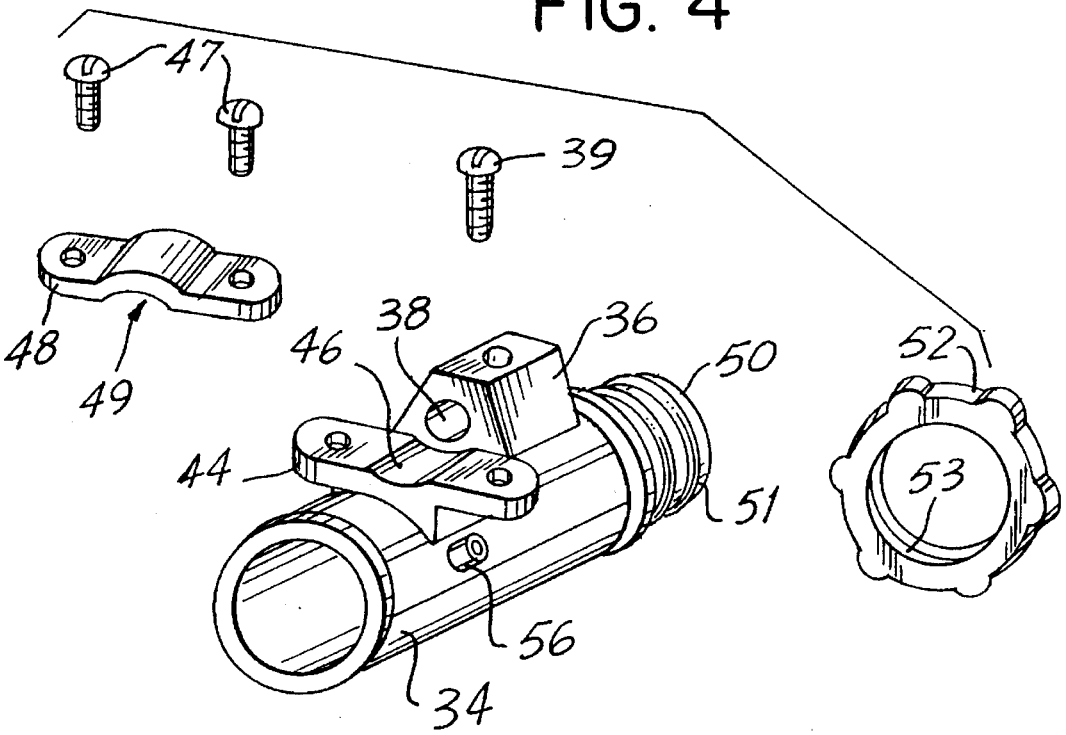
FIG. 4 is another embodiment of the electrical pipe fitting of the present invention having an integral grounding fixture.
Figure 5:
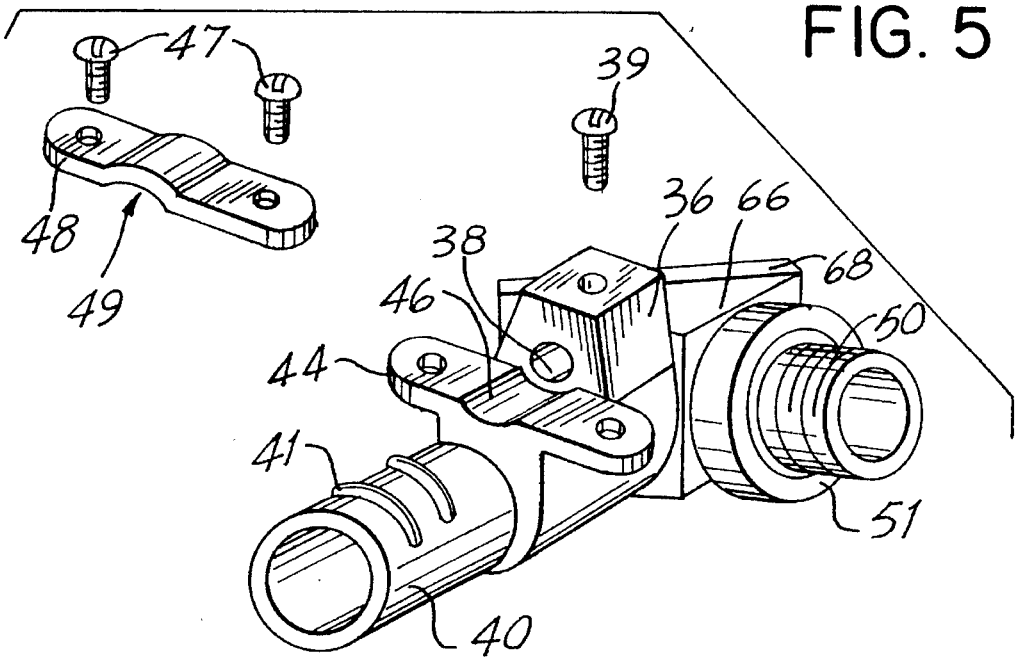
FIG. 5 is a fourth embodiment of the pipe fitting having an angled corner.
Figure 10:
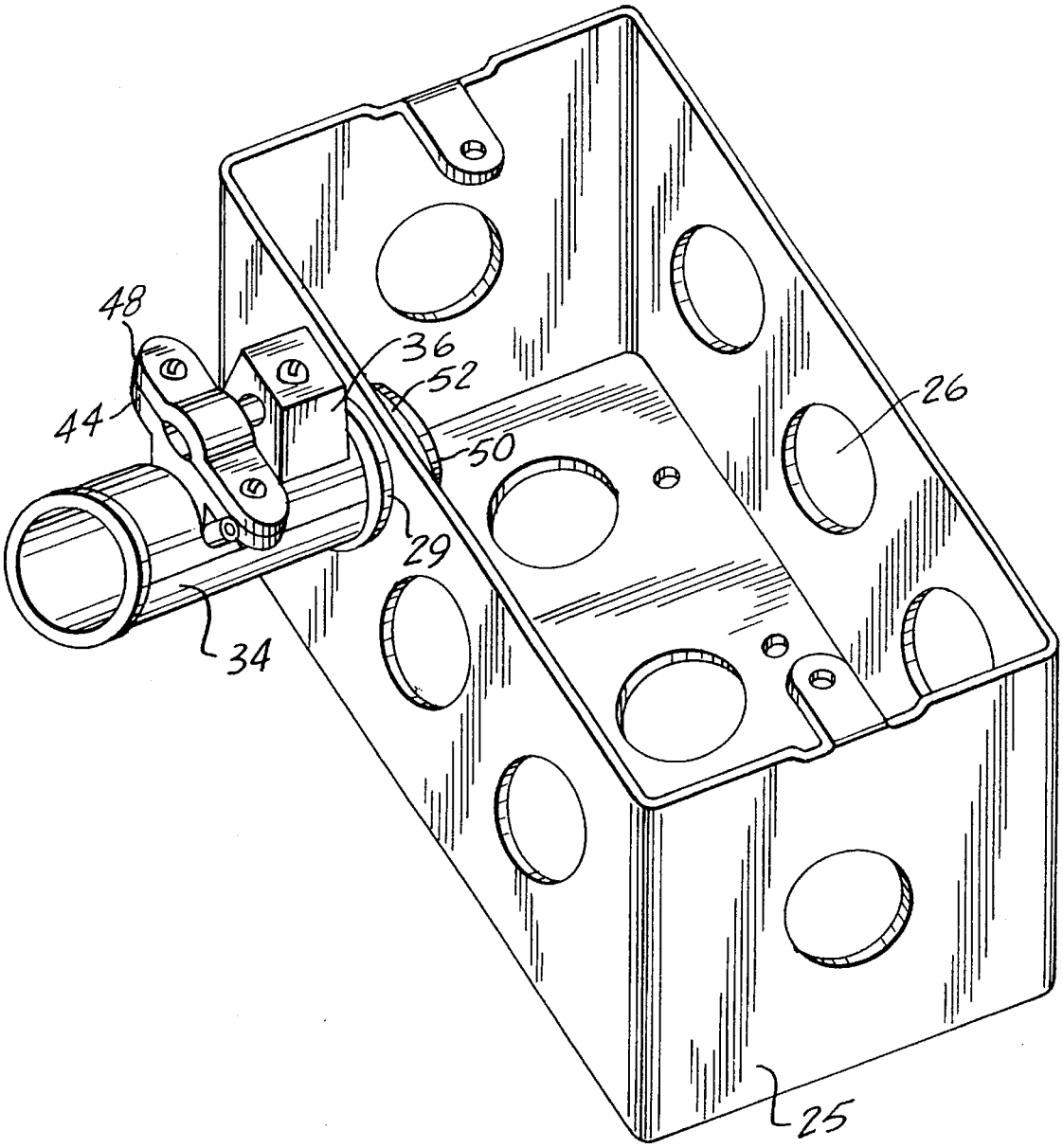
FIG. 10 illustrates the receptacle box with the electrical pipe fitting of FIG. 4.
Figure 11:
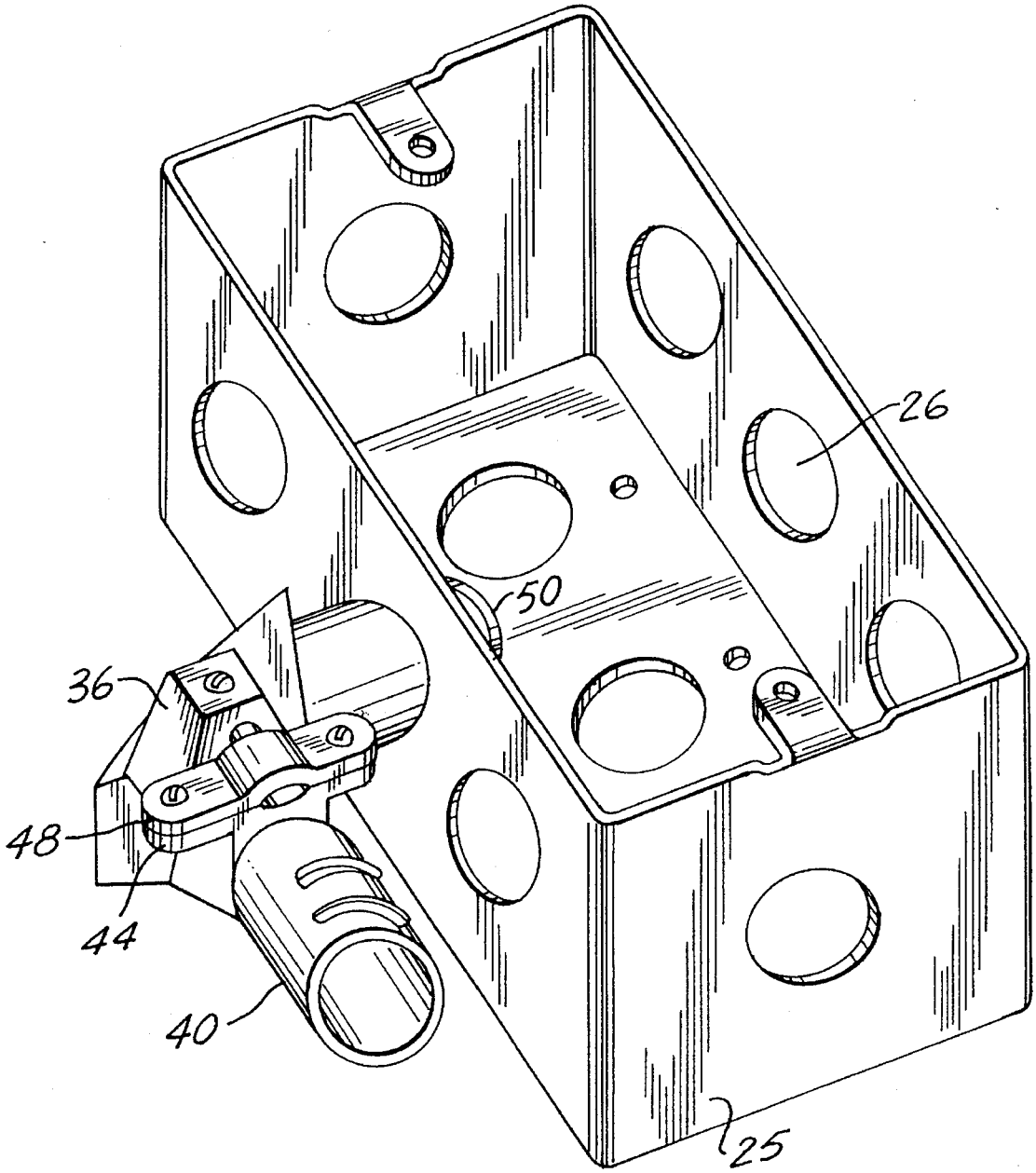
FIG. 11 is a perspective view of a receptacle box with the pipe fitting of FIG. 5.

A third embodiment shown in FIGS. 4 and 10 is similar to the embodiment of FIGS. 3 and 9, except that raised portion 36 and platform 44 are formed integral with tubular member 34, rather than on a separate sleeve.

A fourth embodiment of the invention, shown in FIGS. 5–7 and 11, is similar to the embodiment of FIG. 2, with the exception that tubular member 34 is formed with an angled corner 66 which accommodates various installation configurations.

A removable cover 68 is provided to facilitate installation and threading of electrical wires through the angled corner of the fitting. Removable cover 68 fits over an opening 67 in the angled corner 66, as shown in FIG. 6.

Figure 6:
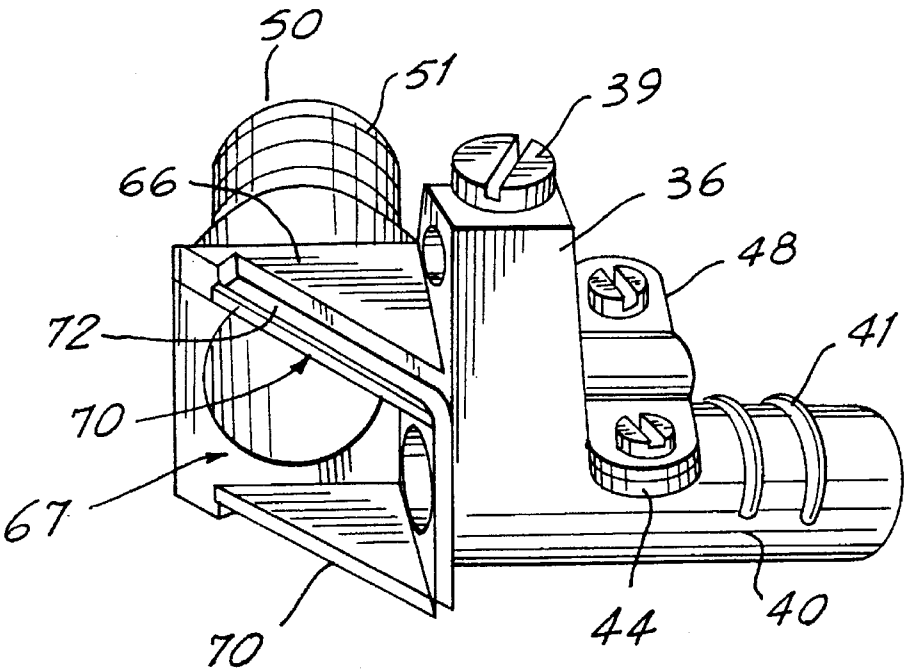
FIG. 6 is a back view of the pipe fitting of FIG. 5.
Figure 7:
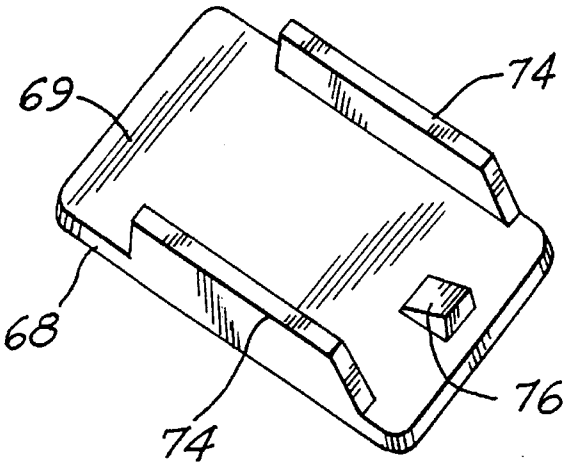
FIG. 7 illustrates a slidable cover used over the angled corner of the fitting of FIG. 5.

Referring to FIGS. 6 and 7, a locking mechanism is provided to removably secure the cover 68 onto angled corner 66. As shown in FIG. 6, tracks 70 are provided on opposite sides of opening 67. The tracks are equipped with stops 72. As shown in FIG. 7, hooked projections 74 are provided on opposite edges extending from the inner surface 69 of cover 68. Removable cover 68 also includes a small ramp 76 at one end disposed midway between hooked projections 74. To install cover 68, hooked projections 74 are slidably engaged over tracks 70, and the cover 68 is slid forward until projections 74 come to rest against stops 72, at which point the removable cover fully occludes the opening. Inadvertent opening of cover 68 is impeded by ramp 76 which frictionally engages an edge of the opening.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electrical pipe fitting, comprising:

a hollow metal tubular member for receiving electrical wire, said tubular member having a first end and a second end, said tubular member being adapted to be coupled to a grounded electrical pipe at said first end, said tubular member also being adapted to be removably connected to an electrical receptacle box at said second end;

means for attaching a section of the electrical pipe to the fitting;

means for securing the fitting to the receptacle box;

a raised portion extending from said tubular member, said raised portion having an aperture for receiving and securing a grounded wire, whereby a ground path is established between the grounding wire and the electrical pipe; and means for securing the grounding wire within the aperture of said raised portion, comprising a screw which extends into said aperture of said raised portion and presses an uninsulated portion of the grounding wire against said hollow tubular member.

2. The electrical pipe fitting as recited in claim 1, wherein said means for securing the grounding wire further comprises a clamp disposed adjacent said aperture for securing the uninsulated portion of the grounding wire.

3. The electrical pipe fitting as recited in claim 1, wherein the raised portion is formed integrally with said tubular member.

4. The electrical pipe fitting as recited in claim 1, further comprising a sleeve, said tubular member extending through the sleeve, and said raised portion being formed integrally with and extending from said sleeve.

5. The electrical pipe fitting as recited in claim 1, wherein said tubular member includes an angled corner, such that said first and second ends are perpendicular to each other.

6. The electrical pipe fitting as recited in claim 5, further comprising a removable cover disposed on said angled corner.

7. The electrical pipe fitting assembly as recited in claim 6, further comprising locking means for preventing unintentional displacement of said removable cover from said angled corner.

8. The electrical pipe fitting as recited in claim 1, wherein the section of electrical pipe is received over said first end and said means for attaching the section of electrical pipe comprises a plurality of ridges on said first end of said tubular member.

9. The electrical pipe fitting as recited in claim 1, wherein the section of electrical pipe is received within said first end and said means for attaching the section of electrical pipe comprises an aperture in the first end of said tubular member and a screw extending through the aperture to secure the section within the first end.

10. An electrical pipe fitting, comprising:

a hollow metal tubular member for receiving electrical wire, said tubular member having a first end and a second end, said tubular member being adapted to be coupled to a grounded electrical pipe at said first end, said tubular member also being adapted to be removably connected to an electrical receptacle box at said second end;

means for attaching a section of the electrical pipe to the fitting;

means for securing the fitting to the receptacle box, comprising a collar having threads which mate with threads located on said second end of the fitting to secure the fitting within the receptacle;

a raised portion extending from said tubular member, said raised portion having an aperture for receiving and securing a grounded wire, whereby a ground path is established between the grounding wire and the electrical pipe; and means for securing the grounding wire within the aperture of said raised portion.

* * * * *